United States Patent [19]

Kirkhouse

[11] Patent Number: 4,644,218

[45] Date of Patent: Feb. 17, 1987

[54] SPARK PLUG WITH PRE-COMBUSTION CHAMBER AND VENTURI PASSAGE

[75] Inventor: Henry A. Kirkhouse, Torquay, Australia

[73] Assignee: Kirkhouse Jet Plug Pty. Ltd., Victoria, Australia

[21] Appl. No.: 774,880

[22] PCT Filed: Jun. 16, 1981

[86] PCT No.: PCT/AU81/00073

§ 371 Date: Feb. 16, 1983

§ 102(e) Date: Feb. 16, 1983

[87] PCT Pub. No.: WO82/04504

PCT Pub. Date: Dec. 23, 1982

Related U.S. Application Data

[63] Continuation of Ser. No. 474,589, Feb. 16, 1983, abandoned.

[51] Int. Cl.[4] ..... H01T 13/32

[52] U.S. Cl. ..... 313/120; 313/143

[58] Field of Search ..... 313/118, 120, 122, 132, 313/138, 139, 141, 143; 123/169 R, 169 EL, 169 V

[56] References Cited

U.S. PATENT DOCUMENTS 1,963,801 6/1934 O'Marra ..... 313/120
3,056,899 10/1962 Clayton ..... 313/143
3,076,912 2/1963 Novak et al. ..... 313/118 X
3,710,772 1/1973 Warner ..... 313/138 X

*Primary Examiner*—David K. Moore
*Assistant Examiner*—K. Wieder
*Attorney, Agent, or Firm*—Cushman, Darby & Cushman

[57] ABSTRACT

A spark plug adapted, in use, for association with an axial passage (38, 38', 54). The spark plug includes an insulator member (21) having an electrode (23, 23') disposed centrally thereof and projecting outwardly from one end thereof; and an electrode member (28, 47) at said one end of said insulator member surrounding and spaced from said centrally disposed electrode. The electrode member is so shaped to define, with the insulator member a pre-combustion chamber (30) surrounding the centrally disposed electrode. The electrode member has an aperture (29, 49) to receive the extreme end of said centrally disposed electrode of said insulator member. The electrode member further includes a plurality of additional separate apertures (31, 50) adjacent the central aperture (29, 49), and which allow for fluid communication between the pre-combustion chamber (30) and the associated axial passage (38, 38', 54). In one embodiment the axial passage is a straight passage (38') provided in an adaptor member in which the spark plug is received. In other embodiments the axial passage is a venturi passage (38) provided in a similar adaptor member, or a venturi passage (54) provided in the spark plug port of an associated engine.

7 Claims, 11 Drawing Figures

SPARK PLUG WITH PRE-COMBUSTION CHAMBER AND VENTURI PASSAGE

This is a continuation of application B, Ser. No. 474,589, filed Feb. 16, 1983, which was abandoned upon the filing hereof.

TECHNICAL FIELD

The present invention relates to an improved spark plug assembly, and in particular, but not exclusively, to a spark plug assembly for an internal combustion engine.

BACKGROUND ART

Conventional spark plug assemblies suffer from a number of disadvantages, resulting in inefficient, ineffective and/or uneven cumbustion at or in the vicinity of the associated cylinder of the internal combustion engine, one result of which can be the build-up of undesirable carbon and/or other impurities on the electrodes of the spark plug assembly ultimately affecting the overall operation of the spark plug assembly. Known spark plug assemblies also have a tendency to produce undesirable "pre-ignition". Furthermore, known spark plug assemblies are also somewhat unreliable in "firing" unless the conditions prevailing in their immediate vicinity are correct, for example, the presence of substances such as oil have been found to prevent "firing".

Conventional spark plugs have also been found to suffer from heat transfer problems, particularly when associated with high-performance engines where it has been found that heat transfer through the spark plug assembly often results in undesirable over heating, and ultimately, damage to the insulator body of the plug.

As one example of known spark plug assemblies, attention is directed to Australian Patent Specification No. 159,863 which discloses a spark plug fitted with an adaptor defining a pre-combustion chamber. The spark plug employed therein was of a conventional design capable of working normally without the adaptor, although without the adaptor the plug suffered in performance as a result of the loss of the anti-fouling capability achieved with the adaptor. However, such a combination of spark plug and adaptor has now been found to result in a long heat transfer path, and with the advent of more sophisticated high-performance engines, arrangements such as those disclosed in the patent Specification No. 159,863 have been found to suffer as a result of the undesirable over-heating referred to above.

The present invention therefore seeks to alleviate the problems and disadvantages associated with known spark plug assemblies, and to provide a spark plug which will allow for even combustion of the combustible gases in the cylinder of an associated internal combustion engine.

DISCLOSURE OF THE INVENTION

The spark plug in accordance with the present invention incorporates means to define a special pre-combustion chamber for initial or preliminary combustion of combustible gases and for subsequently spreading the combustion with a desired rapidity, all without increasing the effective overall length of the spark plug assembly. In fact, with the assembly in accordance with the present invention, it is possible to reduce the overall length of the spark plug assembly. The spark plug assembly in accordance with the present invention furthermore minimises, if not eliminates altogether, the problems involved with over-heating.

In accordance with the present invention there is provided a spark plug adapted, in use, for association with an axial passage, said spark plug including; an insulator member having an electrode disposed centrally thereof and projecting outwardly from one end thereof; and an electrode member at said one end of said insulator member surrounding and spaced from said centrally disposed electrode, wherein said electrode member is so shaped to define, with the insulator member, a pre-combustion chamber surrounding the centrally disposed electrode, electrode member having an aperture to receive the extreme end of said centrally disposed electrode of said insulator member, said electrode member further including a plurality of additional separate apertures adjacent said central aperture, said additional apertures adapted to allow for fluid communication between the pre-combustion chamber and any said associated axial passage.

Apart from defining the pre-combustion chamber for the spark plug, the effect of which will be later described, the electrode also; performs the function of an earth electrode completely surrounding the centrally disposed electrode; assists in cooler operation of the plug in a manner to be later discussed; and functions as a gas seal.

BRIEF DESCRIPTION OF THE DRAWINGS

Several preferred embodiments of the invention will now be described with reference to the accompanying drawings, in which.

BEST MODE FOR CARRYING OUT THE INVENTION

Figure 1:
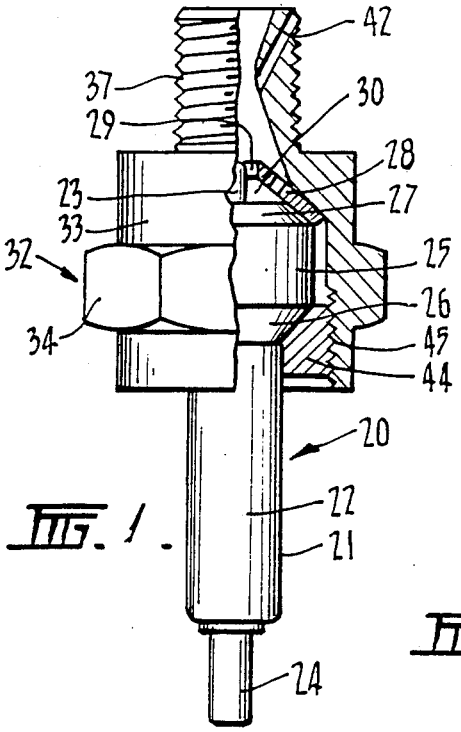
FIG. 1 is a partly sectioned side elevational view of a first embodiment of the spark plug assembly in association with an adaptor providing an axial venturi passage and adapted to be received in the conventional spark plug port in the cylinder head of an internal combustion engine.
Figure 3:
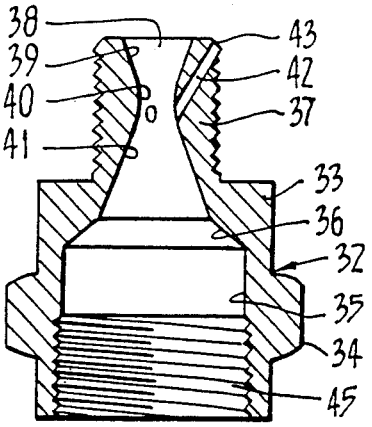
FIG. 3 is a cross-sectional side elevational view of the adaptor of FIG. 1.
Figure 4:
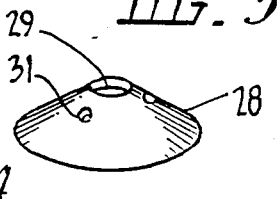
FIG. 4 is a perspective view of the electrode member forming part of the spark plug of FIG. 1.
Figure 5:
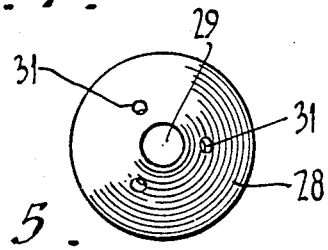
FIG. 5 is a plan view of the electrode member of FIG. 4.
Figure 2:
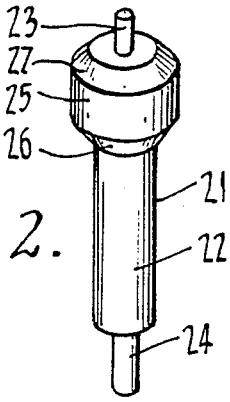
FIG. 2 is a perspective view of the insulator of the spark plug assembly of FIG. 1.

Referring to FIGS. 1 to 5 of the drawings, the first embodiment of the spark plug assembly of this invention, and generally designated as 20, includes an insulator member 21 having an insulator body 22 of cylindrical configuration and a conductor disposed centrally therethrough and projecting outwardly from one end as shown to provide the main electrode 23 and extending outwardly from the other end to provide a conventional electrical connector terminal 24. The insulator body 22 at its end adjacent the main electrode 23 is enlarged as shown to provide a cylindrical section 25 of larger diameter than the remainder of the body, a frusto-conical section 26 between the cylindrical section 25 and the remainder of the insulator body, and a further frusto-conical section 27 adjacent the main electrode 23. The remaining component of the spark plug assembly is provided by an electrode member 28, which in this embodiment is of a hollow conical configuration angled to match the angle of the frusto-conical section 27 of the insulator member 21 so as to seat thereon when the electrode member is placed in position on the end of the insulator member adjacent the main electrode 23 as shown in FIG. 1. The conical electrode member 28 has a centrally disposed aperture 29 at the apex thereof through which the main electrode 23 is received with the tip of the electrode 23 and the apex of the conical electrode member 28 being substantially in alignment.

The diameter of the central aperture 29 is greater than the diameter of the main electrode 23 to form an annular spark gap extending completely around the main electrode. When in position, the conical electrode member 28 defines a pre-combustion chamber 30 between itself and the end of the insulator body 22 and surrounding the main electrode 23. The conical electrode member 28 incorporates additional apertures 31, in this case three equally spaced apart apertures, and so positioned relative to the central aperture 29 that, when placed in position on the insulator member 21, they will be in direct fluid communication with the pre-combustion chamber 30.

The spark plug assembly of this embodiment is, in use, associated with an adaptor member generally indicated as 32. The adaptor member has a cylindrical main body portion 33 about which a hexagonal flange 34 is formed for engagement by a spanner during fitting of the adaptor member to the spark plug port of an associated cylinder head. The remainder of the adaptor member consists of an externally threaded extension 37 complementing the internally threaded spark plug port of an associated cylinder head. The adaptor member has an axial passage therethrough shaped to provide a large diameter chamber 35 adapted to receive the enlarged end of the spark plug assembly 20; and a frusto-conical portion 36 angled to match the angle of the conical electrode member 28 of the spark plug assembly such that, the section of the conical electrode member radially outwardly of the apertures 31 will be firmly clamped between the frusto-conical section 27 of the insulator body and the frusto-conical portion 36 of the adaptor member when the spark plug assembly is inserted within the adaptor as shown in FIG. 1. With this particular adaptor, the axial passage is completed by a venturi shaped portion 38 extending through the threaded extension 37 and opening outwardly through the end of the adaptor. The venturi shaped portion 38 consists of an outer tapered section 39, a curved intermediate throat section 40 and an inner tapered section 41. A plurality of elongate ports 42, in this case four, are provided through the wall of the extension 37 and angled to open outwardly through a chamfered face 43 around the end of the extension 37 and to open inwardly at the throat section 40 on the inner tapered section 41 side thereof. As shown in FIG. 1, the spark plug assembly 20, comprising the insulator member 21 and the electrode member 28, and in accordance with this preferred form of the invention, is positioned within the adaptor member 32 and retained in place by an annular retaining ring 44 having an external thread cooperating with an internally threaded section 45 within the chamber 35 of the adaptor member. As shown in FIG. 1, the section of the electrode member radially outwardly from the apertures 31 is clamped between the respective frusto-conical sections 27 and 36 of the insulator body and the adaptor member respectively, such that the apertures 31 will allow fluid communication between the pre-combustion chamber 30 within the spark plug assembly and the inner tapered section 41 of the venturi passage within the adaptor member.

The second embodiment of the invention shown in FIGS. 6 to 9, represents a modified form of spark plug assembly 20' and in which the same reference numerals have been used to identify features identical with those of the first embodiment. The adaptor member 32 is identical in all respects with the adaptor associated with the spark plug assembly of the first embodiment, and the same reference numerals are used to identify its constructional details.

However, in this embodiment, the central main electrode 23' is shortened, and the end of the insulator body 22 is of an inverted nose configuration providing a concave cavity 46. The electrode member 47 of this embodiment is of hollow frusto-conical configuration providing a flat end wall 48 through the centre of which the main aperture 49 for receiving the tip of the main electrode 23' is provided, and through which face three additional apertures 50 are formed. The electrode member 47 defines, with the cavity 46, a pre-combustion chamber 30' which, as with the first embodiment, communicates with the inner section 41 of the venturi passage within the adaptor member 32 via the additional apertures 50. As with the first embodiment, the radially outer section, in this case the conical skirt, of the electrode member 47 is clamped between the respective frusto-conical surfaces 27 and 36 of the insulator body and adaptor member respectively.

In the two embodiments described above, the spark plug assemblies are, in use, associated with an adaptor member within which the spark plug assembly is received and in which a venturi passage is provided. The adaptor is in turn received in the conventional spark plug port in the cylinder head of an internal combustion engine. As an alternative, the adaptor member, being a separate integer, may be dispensed with and the spark plug port through the cylinder head modified to provide a venturi passage, whereby the spark plug assembly may be received directly within the spark plug port.

Figure 10:
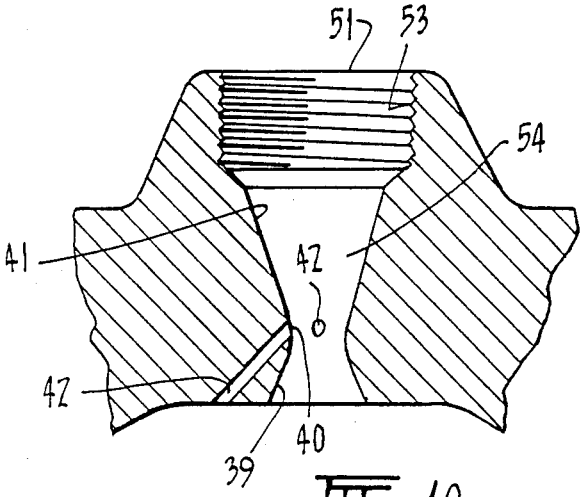
FIG. 10 is a sectional view of a modified form of cylinder head configuration at the spark plug port and incorporating an axial venturi passage as an alternative to the adaptor with which the spark plug assembly is associated in the preceding embodiments.

Such a modified spark plug port configuration for the cylinder head of an internal combustion engine is shown in FIG. 10. As shown, the spark plug port 51 in the cylinder head 52 has an outer chamber 53 adapted to receive and retain either of the spark plug assemblies 20 or 20' of the preceding embodiments, that is, the insulator member and electrode member combinations 21, 28 of FIGS. 1 to 5 or 11, or 21, 47 of FIGS. 6 to 9. The spark plug port further includes an inner section 54 in the form of a venturi similar to that provided in the adaptor member of the preceding embodiments, having outer, throat and inner sections 39, 40 and 41, with elongate ports 42 opening at one end into the cylinder chamber of the engine and at the other end into the throat section 40 on the inner tapered section 41 side thereof. In this situation the electrode member may be provided with a skirt extending down the side of the insulator member to assist in locating the electrode member in position and providing for additional heat transfer.

Figure 11:
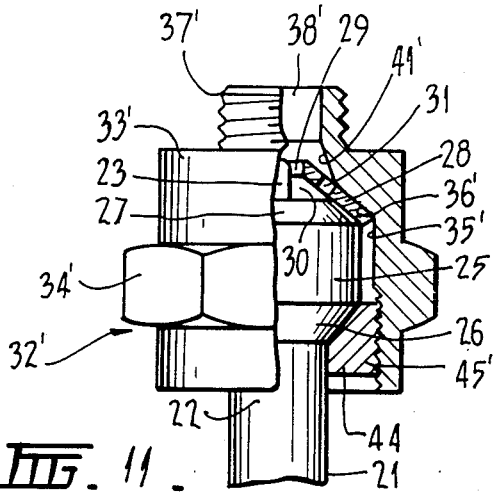
FIG. 11 is a partly sectioned side elevational view of the spark plug assembly of FIGS. 1 to 5 in association with an alternative form of adaptor providing a straight axial passage.
Figure 9:
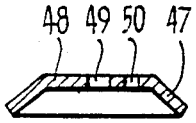
FIG. 9 is a cross-sectional side elevational view of the electrode member of FIG. 8.
Figure 8:
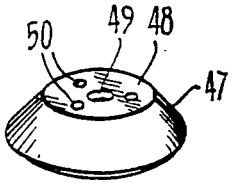
FIG. 8 is a perspective view of the electrode member forming part of the spark plug assembly of FIG. 6.
Figure 7:
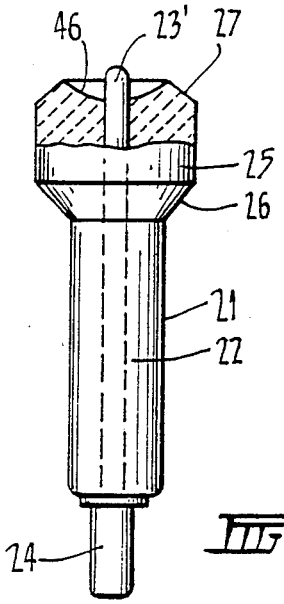
FIG. 7 is a partly sectioned side elevational view of the insulator of the spark plug assembly of FIG. 6.
Figure 6:
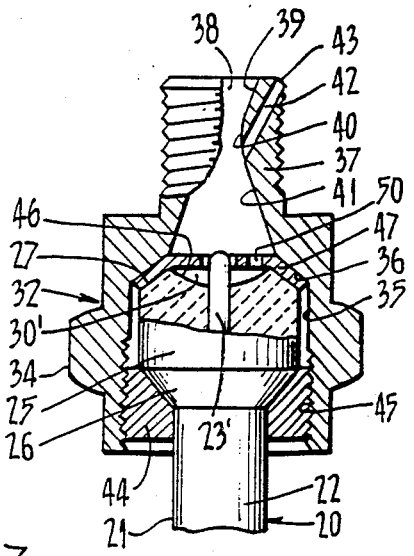
FIG. 6 is a partly sectioned side elevational view of a second embodiment of the spark plug assembly in association with an adaptor the same as the previous embodiment.

In the embodiments described above the preferred forms of spark plug assemblies are associated with venturi passages either provided in a special adaptor, as per the embodiments of FIGS. 1 to 9, or in the spark plug port in the cylinder head as shown in FIG. 10. However, certain of the advantages of the spark plug assembly can also be achieved without being associated with a venturi passage, that is, by direct association with an existing spark plug port which provides an associated axial passage of straight configuration. The construction of the spark plug assembly may be modified to provide an externally threaded sleeve adapted to cooperate with the existing internally threaded spark plug port, or by incorporating an adaptor which receives the spark plug assembly and is receivable within the existing spark plug port in a similar manner to the adaptor with which the spark plug assembly is associated in the embodiment of FIGS. 1 to 9, except that the venturi passage 38, and elongate ports 42, are dispensed with and the threaded extension 37 is shortened. Such an adaptor is shown in FIG. 11 in which the same reference numerals have been used for the spark plug assembly which is identical to that of the preceding embodiments. The modified adaptor is indicated as 32' has a main body portion 33'; hexagonal flange 34'; chamber 35'; frusto-conical portion 36' and internally threaded section 45' as for the adaptor of the preceding embodiments. However, the threaded extension 37' is somewhat shorter than that of the preceding embodiments and merely incorporates a straight axial passage 38' which, together with the spark plug port, provides an associated axial passage, and which widens at its inner end at 41' to allow for fluid communication between the axial passage 38' and the pre-combustion chamber 30 within the spark plug assembly (30' when a spark plug assembly in accordance with the embodiment of FIGS. 6 to 9 is utilised).

The basic principle of operation of the spark plug assembly according to this invention will now be described.

Upon compression of combustible gases drawn into an associated cylinder during a preceding induction stroke, the combustible gases accumulate in the axial passage 38 (FIGS. 1 and 3) or 54 (FIG. 10) or 38' (FIG. 11) and also accumulate in the pre-combustion chamber 30 or 30' of the spark plug assembly 20 or 20' via the various apertures through the electrode member 28 or 47. Upon subsequent firing some of the combustible gas in the pre-combustion chamber immediately behind the electrode member will ignite, although a majority of the charge against the end of the insulator body will not have a chance to ignite. This fact has been confirmed by tests carried out where examination of the spark plug assembly after use has shown no sign of detonation on the surface of the electrode member, whilst the face of the insulator body was still wet with uncombusted fuel. Simultaneously, combustion gases within the axial passage are ignited and are expanding behind a flame front (hereinafter referred to as the "primary" burn) moving through the axial passage and into the cylinder chamber. The ignited and expanding gases within the pre-combustion chamber of the spark plug assembly (hereinafter referred to as the "secondary" burn) having no other avenue of escape rapidly flow outwardly through the apertures in the electrode member followed by the relatively larger volume of uncombusted gases.

It will be observed that the electrode member forming part of the spark plug assembly of this invention, apart from providing one of the necessary pair of electrodes for the creation of a spark, provides an additional heat transfer path directly to the cylinder head which assists in keeping the spark plug assembly cool as well as acting as a gas seal. Furthermore, if the main electrode is positioned accurately in the centre of the aperture in the surrounding electrode member a ring of sparks around 360° of the central electrode is produced providing efficient and symmetrical ignition, which in turn is believed to account for the easier engine starting which has been observed for engines fitted with spark plug assemblies in accordance with the present invention. Where the spark plug assembly is associated with a venturi passage as incorporated in the adaptor of FIGS. 1 and 3 (venturi passage 38) or in the spark plug port as in FIG. 10 (venturi passage 54), an additional effect is achieved, as follows. As the combusted gases for the "primary" burn move out of the venturi passage a partial vacuum, or at least a reduced pressure, is generated in the venturi passage which has the effect of increasing the speed at which the products of the "secondary" burn move through the venturi passage, and the net result of the dual burn effect is an increase in the velocity of the products of both burns through the venturi leading to a considerable reduction in pressure within the venturi passage. Although it is not entirely clear why the double burn effect produces such a great increase in velocity and reduction in pressure in the venturi passage, one possibility is that the high velocity of the products of the second burn cause it to catch up to the products of the first burn to act thereupon and thrust them through the throat of the venturi. Another possibility is that the second burn flows through to the decomposed gases preceding the flame front of the first burn as it moves through the throat of the venturi. It is believed that the velocity of the first burn accelerates from an initial speed of in the order of 50 to 60 feet/sec. to something in the order of 100 feet/sec. aproaching the throat of the venturi passage before being caught by the second burn moving at a velocity of possibly up to 1100 feet/sec. As a result of the considerably reduced pressure generated in the venturi, further combustion gases are rapidly drawn through the elongate ports 42 providing communication between the cylinder chamber and the venturi passage to prime or recharge the venturi passage, and the pre-combustion chamber within the spark plug assembly, ready for the next ignition stage, thus eliminating the time delay associated with priming the space adjacent the spark plug assembly during the next compression and ignition stage. The priming or recharging action also has the advantage that the relatively cooler priming gases cool and clean the central main electrode and the surrounding electrode member.

In general, the spark plug assemblies in accordance with the present invention exhibit a greater lifetime without requiring cleaning or replacement. The prevention of carbonization or fouling of the points also effectively eliminates the disadvantages of gradual loss of engine power and inefficient running generally associated with the prior art spark plug assemblies.

The arrangement in accordance with the present invention also has been found to give rise to what may be termed a flattening of the flame front, thereby reducing to a certain extent the possibility of the production of long fingers of flame which have been found in the past to give rise to unwanted decomposition of the fuel ahead of the flame front, eventually leading to detonation.

In practical terms the arrangement in accordance with the present invention has been found to give rise to substantial improvements in at least three performance parameters of an internal combustion engine, namely an improvement in the indicated mean effective pressure (i.m.e.p.); a reduction in the octane requirement for the fuel (even to the extent that it has been shown that engines previously requiring high octane (super) fuels can still achieve equivalent or better performance with low octane (standard) fuels); a reduction in the overall fuel consumption; and perhaps more importantly, elimination of the necessity for leaded fuels, and a reduction in the emission of pollutants. Also, a test carried out on the engine of a vehicle, which was previously notorious for resulting in accumulation of oil on the spark plug electrodes, has shown that with spark plugs in accordance with the present invention such "oiling" has ceased and in addition original engine performance has been restored.

It is believed that both the exhaust and induction strokes for the motor or engine will be normal in all respects and in the case where a venturi passage is utilised, no burnt gas will be left in such a passage. It has been found that the only adjustment required to be made to any engine in order to accommodate spark plugs in accordance with the invention it is with regard to the timing. To be more specific it has been found preferable to advance the timing by from between 5 and 7 degrees in order to take up or absorb the time lag caused by the pre-combustion of the fuel and the subsequent firing of the mixture by means of a flame instead of a spark.

Finally, a tool has been designed for the purpose of setting and/or checking the spark plug gap in the assembly of the invention. Such a tool will be in the form of a hollow cylinder of an internal diameter sufficient to allow the tool to be positioned around the central electrode of the spark plug assembly in a sliding fit type arrangement. The wall thickness of the tool will preferably be equivalent to the desired spark gap for the spark plug assembly.

What is claimed is:

1. A spark plug system incorporating a spark plug and an associated axial venturi passage, said spark plug including; an insulator member having an electrode disposed centrally thereof and projecting outwardly from one end thereof; and an electrode member at said one end of said insulator member surrounding and spaced from said centrally disposed electrode; wherein said electrode member is so shaped to define, with the insulator member a pre-combustion chamber surrounding the centrally disposed electrode, said electrode member having an aperture to receive the extreme end of said centrally disposed electrode of said insulator member, said electrode member further including a plurality of additional separate apertures adjacent said central aperture, said additional apertures adapted to allow for fluid communication between the pre-combustion chamber and said associated axial venturi passage, and wherein at least one transfer port is provided to allow communication between the cylinder chamber of an associated engine and said venturi passage on the upstream side of the throat thereof.

2. A spark plug as claimed in claim 1, wherein said electrode member is in the form of a hollow conical member and said aperture for receiving said centrally disposed electrode is a central aperture provided through the apex of said conical electrode member.

3. A spark plug as claimed in claim 1, wherein said insulator member has a cavity formed in one end thereof adjacent said central electrode, and said electrode member is of frusto-conical configuration having a flat end wall, and said aperture for receiving said centrally disposed electrode is an aperture provided through the centre of said flat end wall.

4. A spark plug as claimed in claim 2, wherein said additional apertures are equally spaced around said central aperture and radially spaced therefrom.

5. A spark plug as claimed in claim 1, wherein said electrode member is located on a surface of said insulator member surrounding and spaced from said electrode whereby, in use, said electrode member is clamped between said surface and a complementary surface about the adjacent end of said axial venturi passage.

6. A spark plug as claimed in claim 1 in combination with an adaptor member through which said axial venturi passage is provided, and wherein said one end of said spark plug is received and retained within a chamber within said adaptor and communicating with said axial venturi passage.

7. A spark plug as claimed in claim 1, wherein said associated axial venturi passage is provided by the spark plug port in an associated engine body.

* * * * *